US006695413B1

(12) United States Patent
Barwick

(10) Patent No.: US 6,695,413 B1
(45) Date of Patent: Feb. 24, 2004

(54) FUSED BRUSH AND METHOD OF MAKING

(75) Inventor: Gary H. Barwick, Washington, NC (US)

(73) Assignee: Polymer Brush, Inc., Washington, NC (US)

( * ) Notice: Subject to any disclaimer, the term of this patent is extended or adjusted under 35 U.S.C. 154(b) by 0 days.

(21) Appl. No.: 09/569,490

(22) Filed: May 11, 2000

(51) Int. Cl.[7] ..... A46D 3/00; A46B 3/00
(52) U.S. Cl. ..... 300/21; 15/191.1; 15/193
(58) Field of Search ..... 300/21; 15/191.1, 15/193

(56) References Cited

U.S. PATENT DOCUMENTS 3,799,616 A * 3/1974 Lewis, Jr. ..... 300/21
4,637,660 A * 1/1987 Weihrauch ..... 300/21
5,622,411 A * 4/1997 Weihrauch ..... 300/21

FOREIGN PATENT DOCUMENTS

DE 40 14 926 * 11/1991
DE 40 29 610 * 3/1992

* cited by examiner

*Primary Examiner*—Randall E. Chin
(74) *Attorney, Agent, or Firm*—Olive & Olive, P.A.

(57) ABSTRACT

A method and product made thereby is provided in which a brush block is assembled with brush bristles by the method of fusing. The brush is formed with a substrate brush block that has a filler or reinforcing fiber embedded therein, according to a first preferred embodiment. The bristles of the brush are formed into tufts. An attachment end of each tuft of bristles is melted and pressed into a melted tuft cavity formed in the brush block. Upon cooling, the tuft is fixedly welded to the brush block with mechanical attachment. The bristles may be of the same or of a different polymer than the brush block. According to a second embodiment of the invention, brush bristle tufts are assembled to a substrate fibrous mat by the invention method of fusing. An attachment end of each bristle tuft is melted and pressed into intimate contact with the fibers of the mat that are kept at ambient temperature or partially melted. Upon cooling, the tuft is fixedly welded to the mat. The bristles may be of the same or of a different polymer than the brush block.

6 Claims, 2 Drawing Sheets

FUSED BRUSH AND METHOD OF MAKING

FIELD OF THE INVENTION

The present invention relates to the field of brushes and more particularly to such brushes wherein the bristle tufts are fused to the brush base.

BACKGROUND OF THE INVENTION

Brushes have been made by the process of fusing, or thermal welding parts made of thermoplastic polymers, for many years. In this process, the brush base is mounted in a jig and bristles are acquired by picking tubes from a magazine hopper to form tufts. The fusing process involves melting a number of tuft receptor sites in the form of discrete cavities into a surface of the brush base, melting an attachment end of an equal number of tufts of bristles, and quickly inserting the melted tuft ends into the cavities so that the melted tuft ends are pressed into the melted cavities. When the melted resin has flowed together and cooled, the components are permanently welded together. This conventional method of fusing bristles to a brush base is confined to the case in which the two components, the brush base and the bristles, are formed of resins from the same polymer family in order to achieve proper adherence. This similar polymer limitation exists because of the well accepted principle that dissimilar polymers do not weld to one another.

However, the present invention recognizes that a polymer that is chosen for extruding bristles may not be the best choice for a brush base. For example, a polymer chosen for its properties of bristle toughness and flexibility may impose on a brush base a higher resin cost, a higher expense for the molding of a brush base, or inferior properties than would be the case with a polymer chosen initially to mold a brush base. If the brush maker were able to employ bristles of a polymer chosen for its extrusion properties of toughness and flexibility and a base of a polymer chosen for its stability and cost, efficiency, appearance, economy, and other factors would be improved. The invention further recognizes that a resin with dispersed particles or fibers provides a stable, efficient, and economical material from which a brush based could be made, whether the bristles are made of a similar or dissimilar material.

Therefore, it is an object of the present invention to provide a fused brush in which the bristles and the brush base are made of different polymers.

It is a further object of the present invention to provide a fused brush in which the fusion attachment is substantially permanent.

It is an additional object of the present invention to provide a fused brush in which the brush base contains dispersed particles.

It is a still further object of the present invention to provide a fused brush in which the brush base contains dispersed particles and the bristles are of a polymer that is the same as, or different than, the polymer of which the brush base is formed.

These and other objects of the present invention will become apparent through the disclosure of the invention to follow.

SUMMARY OF THE INVENTION

The present invention provides a fused brush and method of making in which the bristles are formed of a first polymer and the base is formed of the same or another polymer. In one preferred embodiment, the brush base is a molded, thermoformed, or extruded block form. The resin forming the block contains dispersed particles of the type generally used for reinforcing polymer rigidity. The brush block is prepared for bristle attachment by pressing a set of heated protuberances into an attachment surface of the block to form cavities with portions of the dispersed particles exposed. Attachment ends of the bristles are softened by contact with a heated surface. The softened bristle ends are then pressed into the melted cavities. It has been discovered that, upon cooling, the particles of the brush block have mechanically engaged the melted ends of the bristles to permanently, mechanically anchor the bristle tufts to the brush block. In brushes having bristles made of the same polymer as that of the brush block, the mechanical grip enhances the weld of the resin fusion.

In a further embodiment in which the base is a woven or looped mat, the bristle tuft ends are melted and the mat either remains cool or is partly melted. When the melted tuft ends are pressed into the mat, the molten polymer flows around the mat fibers and, upon cooling, are permanently, mechanically anchored thereto.

BRIEF DESCRIPTION OF THE DRAWINGS

In order for the invention to become more clearly understood it will be disclosed in greater detail with reference to the accompanying drawings, in which.

DESCRIPTION OF THE PREFERRED EMBODIMENTS

Figure 1:
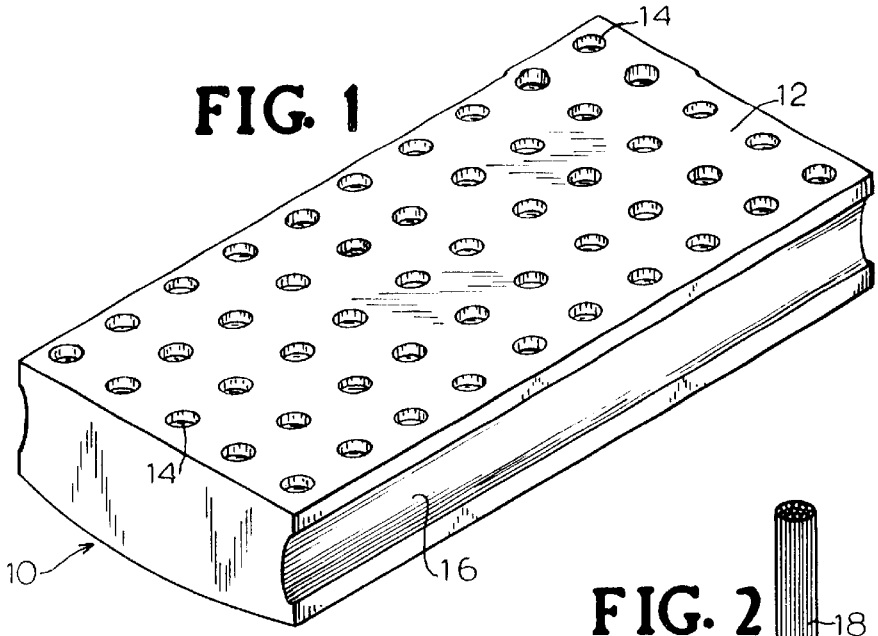
FIG. 1 is a perspective view of a brush block showing a plurality of bristle tuft cavities that have been prepared by melting and ready for the attachment of bristle tufts.

Referring first to FIG. 1, brush block 10 is shown in perspective view with bristle attachment surface 12 visible. Brush block 10 may be formed by molding, thermoforming, or by extrusion. If brush block 10 is formed by extrusion, the resultant elongate extrudate is cut into discrete lengths and the pieces are optionally machined to form rounded corners, for example. A groove 16 may be formed along one or more sides of brush block 10 to provide a grip area. A selected number of bristle tuft cavities 14 are formed into bristle attachment surface 12 in a selected pattern according to the use to which the completed brush will be put. Each bristle tuft cavity 14 is formed by the application of a finger, or protuberance, at a temperature and for a heat contact cycle time that is sufficient to melt a cavity in the polymer of which brush block 10 is formed, as is described more fully below. Bristle tuft cavities 14 are typically in the range of from 0.4 mm (0.015 inch) to 6 mm (¼ inch) deep, and most preferably about 3 mm (⅛ inch) deep.

Figure 2:
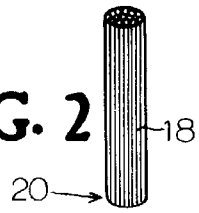
FIG. 2 is a perspective view of a bristle tuft.

Referring now to FIG. 2, bristle tuft 18 is made of a plurality of individual thermoplastic bristles that are substantially parallel to one another. The bristles of which bristle tuft 18 is formed are cut to substantially equal lengths. Attachment end 20 will become connected to brush block 10 at one bristle tuft cavity 14 (see FIG. 3) after the application of heat to fuse the ends of the individual bristles together and create a soft, hot, tuft end. The quantity of bristle tufts 18 to be used is equal to the number of bristle tuft cavities 14.

Figure 3:
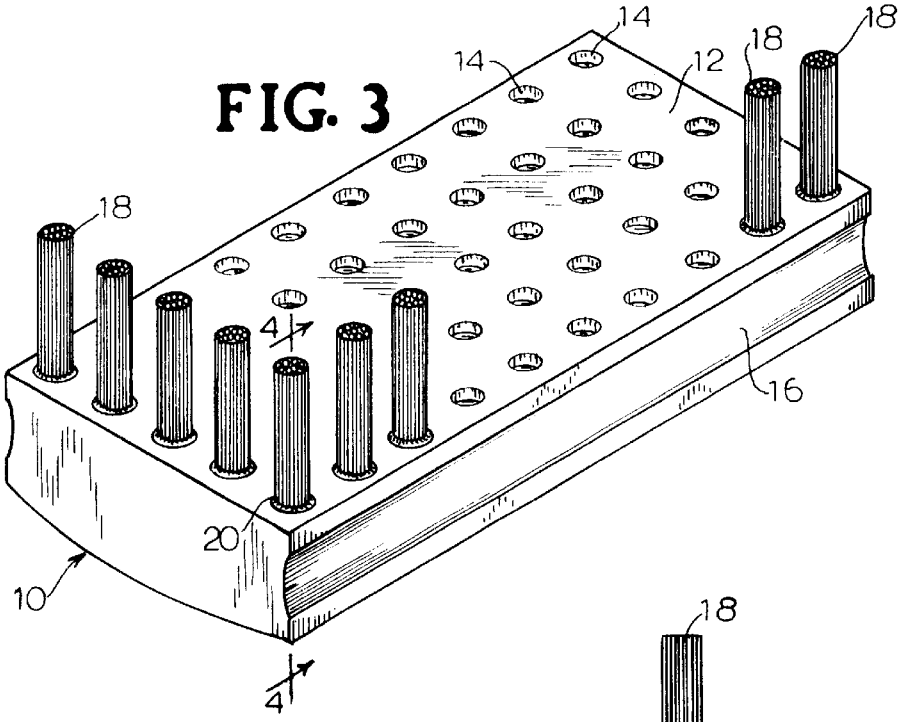
FIG. 3 is a perspective view of the brush block of FIG. 1 with a plurality of bristle tufts of FIG. 2 attached thereto.

FIG. 3 illustrates a partially assembled, fused brush of the first preferred embodiment comprising brush block 10 and a plurality of bristle tufts 18 that are fixedly attached into bristle tuft cavities 14. For purposes of clarity, portions of brush block 10 are shown with bristle tuft cavities 14 unfilled and others having bristle tufts 18 welded in place. However, it is understood that all bristle tufts 18 are welded in place before the fusion process is complete.

Brush block 10 (see FIGS. 3 and 4) is formed of a thermoplastic polymer resin blended with a quantity of embedded particulate, filler, or reinforcing fibrous material (hereafter referred to as "particulate"). A brush block material that is within the scope of the invention contains up to 80% wood particles by weight in a polyethylene resin. Other particulate, for example fiber glass, also works well. As described briefly above, bristle tuft cavities 14 of brush block 10 (see FIG. 1) and attachment ends 20 (see FIG. 2) of bristle tufts 18 are each heated separately to be partly melted. When mating portions of both parts are soft and hot, they are pressed together and held in contact for sufficient time to cool and solidify. The present invention, however, provides for the permanent attachment of bristle tufts and brush blocks of disparate polymers, or of the enhanced attachment of components made of the same polymer, thus expanding the opportunity for design novelty and economy. While it has been known to fuse bristles and brush block of the same polymer, the present invention improves the bond by the inclusion of particulate in the brush block resin.

Figure 4:
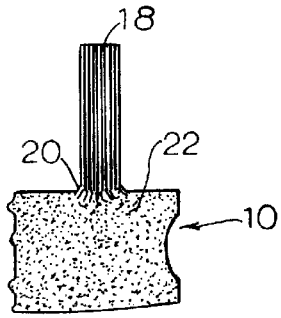
FIG. 4 is a fragmentary, cross sectional view of the bristle block and a bristle tuft of FIG. 3, taken in the direction of line 4—4.

Referring further to FIG. 4, the mechanism by which melted parts are attached to one another involves partially exposing particulate 22 embedded in brush lock 10 through the step of forming each bristle tuft cavity 14 by melting and then causing the melted resin of attachment end 20 of bristle tuft 18 to surround and encapsulate the exposed particulate portions. Melted end 20 cools rapidly when removed from the heat source so as to permanently attach bristle tufts 18 to brush block 10. Recognizing that particulate material 22 remains firm at a temperature sufficient to melt the resin of brush block 10 will provide the mechanical connection that is the focus of the present invention. When the bristles and the brush block are of the same polymer, the embedded particulate enhances the weld tenacity.

The following fused brush assemblies are offered as examples of the first preferred embodiment of the invention:

EXAMPLE 1

Brush block—polyethylene binder with wood particulate; melt temperature=150° C.(300° F.)
Cavity heater temperature=315° C.(600° F.)

Bristles—polypropylene homopolymer, 12 melt; melt temperature=182° C.(360° F.)
Tuft heater temperature=370° C.(700° F.)

Heat contact cycle=5 seconds

EXAMPLE 2

Brush block—polyethylene binder with wood fiber particulate; melt temperature=150° C.(300° F.)
Cavity heater temperature=315° C.(600° F.)

Bristles—Nylon 6, melt temperature 265° C.(510° F.)
Tuft heater temperature 482° C.(900° F.)

Heat contact cycle 5 seconds

In all cases, the heated and melted components were brought into contact with each other rapidly and then allowed sufficient time to cool and solidify under moderate pressure. The heat contact cycle times and temperatures for each set of brush block and bristle combination are subject to adjustment to achieve optimum properties.

Figure 5:
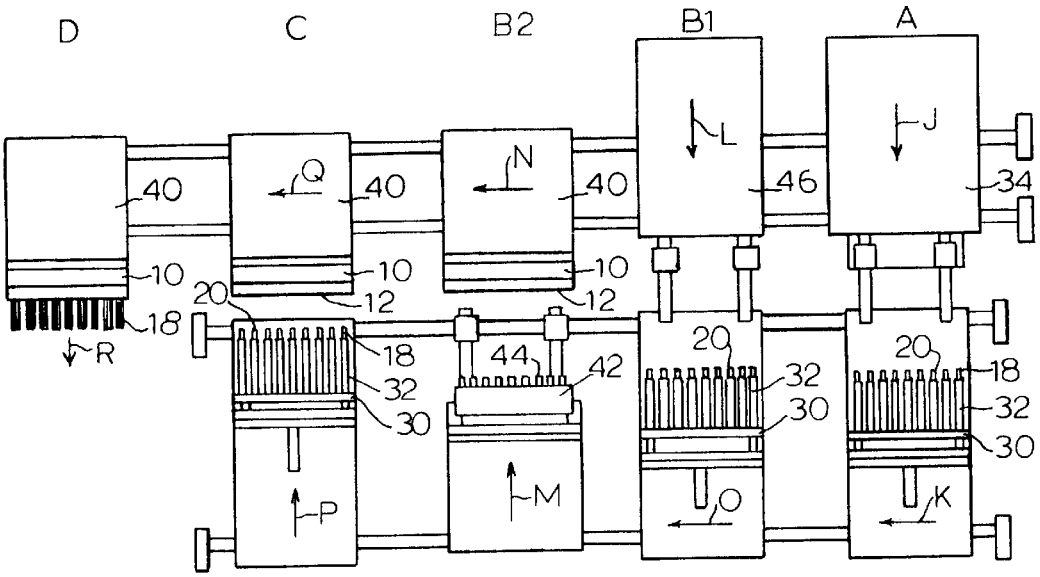
FIG. 5 is a top plan view of an apparatus for making fused brushes according to the invention.

Referring now to FIG. 5, an apparatus for the assembly of fused brushes according to the present invention is illustrated in plan view. The process stations incorporated in the invention method are shown from right to left. The steps taking place at stations B1 and B2 occur substantially simultaneously. Each of the components shown in stations A, B1, B2, C and D are moveable in the directions shown by respective arrows J, K, L, M, N, O, P, Q, R. The description below serves to outline the operational steps of the invention method.

At station A, bristle magazine 34, which contains a multitude of cut-length bristles that are substantially parallel to arrow J, moves in the direction indicated by arrow J. Bristle pickup tubes 32, mounted in a selected array to bristle tube support 30, enter openings (not shown) in bristle magazine 34 to acquire a quantity of bristles and form bristle tufts 18. Bristle tufts 18 are positioned with bristle attachment ends 20 extending beyond the respective ends of bristle pickup tubes 32. While bristle tufts 18 are being assembled in bristle pickup tubes 32, a brush block 10 is mounted into brush base support jig 40 in station B2 in an orientation opposed to bristle tufts 18 so that attachment surface 12 is in a plane that is perpendicular to bristle tufts 18. Next, bristle tube support 30, with tufts 18, moves in the direction shown by arrow K to the previously empty portion of station B1. At station B1, bristle end heater 46 moves in the direction of arrow L to contact and soften attachment ends 20. At the same time, block cavity heater 42 in station B2 moves in the direction of arrow M where tuft cavity fingers 44 melt a series of tuft-receiving cavities 14 (see FIG. 1) in brush block 10. It will be recognized that bristle pickup tubes 32 are arranged in a similar pattern to tuft cavity fingers 44 of block heater 42. The respective temperatures and time sequences for block cavity heater 42 and bristle end heater 46 are selected so that brush block 10 and bristle attachment ends 20 substantially'simultaneously arrive,at an adequately softened condition to permit secure attachment between the respective heated parts when the parts are pressed together. The appropriate temperature and time for melting each polymer may be adjusted for optimum adhesion. Cheated brush block 10 and heated bristle tufts 18 are next transported respectively block support 40 and bristle tube support 30 to station C (block cavity heater 42 has been moved away to allow bristle tube support 30 to pass). At station C, heated attachment ends 20 of bristle tufts 18 are pressed in the direction of arrow P into heated tuft cavities 14 of brush block 10, and held there long enough to cool below the softening temperature of each polymer. At the completion of the cooling process, block support 40 moves in the direction of arrow Q to station D where the completed brush comprising brush block,10 and bristle tufts 18 is ejected in the direction indicated by arrow R. At the completion of the assembly process, bristle magazine 34, bristle tube support 30, bristle end heater 46, block support 40 and block cavity heater 42 all return to their respective initial positions. The preceding description employs directions to describe relative motion of the parts, although in practice opposed components may move, e.g. bristle pickup tubes 32 may move opposite to arrow J as opposed to bristle magazine 34 moving in the direction of arrow J.

A further method of assembling fused brushes involves continuous length bristles (not shown). This continuous filament method combines a multiplicity of such filaments into a tuft, heats an attachment end of the tuft to the point of melting, presses the heated end into a heated cavity in a brush block, allows the heated parts to cool, and cuts the tufts off from the filament supply.

Figure 6:
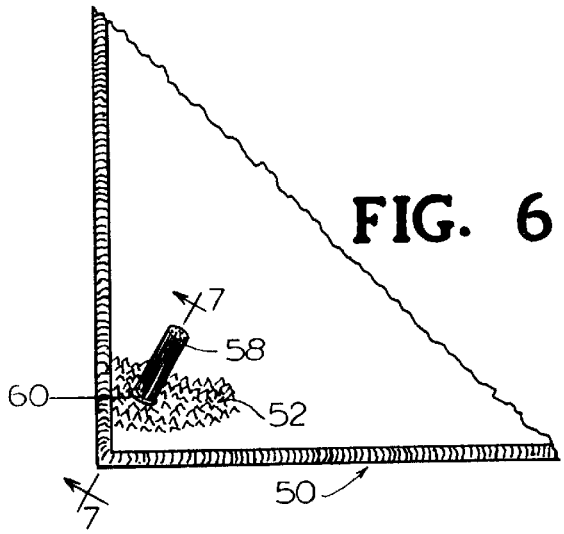
FIG. 6 is a perspective view of a portion of a mat to which one exemplary bristle tuft has been fused according to a second preferred embodiment of the invention.
Figure 7:
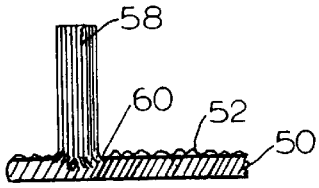
FIG. 7 is an enlarged, fragmentary cross sectional view of the mat and bristle tuft taken along line 7—7 of FIG. 6.

A further preferred embodiment of the present invention is illustrated in FIGS. 6 and 7. This second preferred embodiment serves to permanently attach bristle tufts 58 of a first polymer to brush base loops 52 of mat 50, which loops may be formed of a second polymer or other fiber material. The preferred method of this second embodiment involves heating bristle attachment ends 60 of bristle tufts 58 to the point of softening and not heating any part of mat 50. Thus, loops 52 of mat 50 remain at ambient temperature and remain firm. As noted above with respect to the invention method for making a brush block 10, the time and temperature at which bristle attachment ends 60 are heated affects their softness and flow characteristics. Since loops 52 remain cool, it will be understood that the melting point of the mat fiber is not critical, and that a mat fiber of a polymer having a lower or higher melt point than that of bristle tufts 58 may be used. Bristle attachment ends 60 of bristle tufts 58 are heated to their softening point and pressed into firm contact with loops 52. Since loops 52 are cool and firm, loops 52 present a substantially stiff, fibrous mass into which the molten material of bristle attachment ends 60 can momentarily flow before cooling. Upon cooling, bristle attachment ends 60 surround the fibers of, and become securely attached to, loops 52, thus mat 50. Similar results would be achieved with mat 50 being formed with woven yarns rather than loops 52 as long as interstitial spaces remain open for infiltration by the molten attachment ends of the bristles. In a variant of this second embodiment, partial tuft receptor cavities are melted into the surface of mat 50, leaving a peripheral segment of cool loops 52, thus benefiting both from mechanical attachment to cool loops 52 and welded adhesion to the melted resin.

The following fused mat assemblies are offered as examples of the second preferred embodiment of the invention:

EXAMPLE 3

Mat material—polypropylene looped yarn; melt temperature=182° C.(360° F.)
No heat applied Bristles—polyethylene 20 melt; melt temperature 170° C.(340° F.)
Tuft heater temperature=370° C.(700° F.)

Heat contact cycle 5 seconds

EXAMPLE 4

Mat material—polypropylene looped yarn; melt temperature=182° C.(360° F.)
No heat applied Bristles—polypropylene homopolymer, 12 melt; melt temperature=182° C.(360° F.)
Tuft heater temperature=370° C.(700° F.)

Heat contact cycle=5 seconds

Thus, the invention further recognizes its use in the assembly of bristle tufts and a fibrous mat of the same polymer as shown in Example 4 above. The encapsulation of an ambient temperature fiber matrix within a cooling molten attachment end of a bristle tuft is an economical and effective manufacturing method, whether the tufts and mat are of the same polymer or different polymers.

Therefore, as described above, the first preferred embodiment of the present invention provides a brush having a rigid brush block of a first polymer with particulate material embedded therein that is fused to bristle tufts of a second polymer. The second preferred embodiment provides a fused mat having a flexible fibrous mat of a first polymer and bristles of the same first polymer or of a second polymer.

The above detailed description of preferred embodiments of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A method for making a brush having a base and attached bristles of a thermoplastic polymer, said method comprising:

(a) providing a plurality of bristle tufts formed from multiple individual said bristles of a thermoplastic polymer;

(b) providing a brush base having bristle tuft cavities for said bristle tufts comprising a block formed of a first polymer having particulate material embedded therein and preparing said by melting a select number of bristle tuft cavities into a selected surface of said brush base to expose the particulate material in said bristle tuft cavity;

(c) melting an attachment end of each said bristle tuft;

(d) pressing each said melted attachment end to a respective said bristle tuft cavity on said brush base with sufficient pressure to permit said bristles to become mechanically engaged with said exposed particulate material in the bristle tuft cavity; and (e) allowing said attachment ends to cool and harden in mechanically anchored relationship to said brush base.

2. A method according to claim 1 wherein said bristles are formed of a second polymer.

3. A fused brush made according to the steps comprising:

(a) collecting a plurality of bristles formed of a first thermoplastic polymer and residing in substantially parallel orientation as a selected number of tufts;

(b) holding a brush base formed of a second thermoplastic polymer, having particulate material embedded therein, in a support jig with a selected surface of said brush base oriented substantially perpendicular to said tufts melting a selected number of bristle tuft cavities on said selected surface configured to receive said tufts into said selected surface of said brush base;

(c) melting an attachment end of each of said tufts;

(d) pressing said melted end of each of said tufts to said bristle tuft cavities; and (e) allowing said melted tuft attachment ends to cool and harden.

4. A fused brush according to claim 3 wherein the selected number of tufts equals the selected number of bristle tuft cavities.

5. A fused brush comprising:

(a) selected number of tufts each having a plurality of bristles formed of a thermoplastic polymer and wherein said bristles are substantially similar in length, each of said tufts comprising an attachment end;

(b) a brush base formed of a thermoplastic polymer having particulate material embedded therein and having a bristle attachment surface with a selected number of bristle tuft cavities, each bristle tuft cavity presenting an array of exposed particulate material formed into said bristle attachment surface and configured to receive said attachment ends; and (c) said attachment ends having been melted and securely attached to said bristle tuft cavity.

6. A brush according to claim 5 wherein the selected number of bristle tuft cavities equals said selected number of tufts.

* * * * *